United States Patent [19]

Cockman

[11] Patent Number: 4,923,165

[45] Date of Patent: May 8, 1990

[54] STABILIZED POST ANCHOR

[76] Inventor: Boyce R. Cockman, 500 Howell Rd., Greenville, S.C. 29615

[21] Appl. No.: 399,328

[22] Filed: Aug. 28, 1989

Related U.S. Application Data

[63] Continuation-in-part of Ser. No. 189,755, May 2, 1988, Pat. No. 4,863,137.

[51] Int. Cl.[5] ..... F16M 13/00

[52] U.S. Cl. ..... 248/545; 52/157; 248/156

[58] Field of Search ..... 248/156, 545, 534, 532, 248/533; 52/157, 165, 298, 154

[56] References Cited

U.S. PATENT DOCUMENTS

| | | | |
|---|---|---|---|
| 204,246 | 5/1878 | Pierce | 52/157 |
| 284,219 | 9/1883 | Mehew | 52/165 X |
| 2,569,528 | 10/1951 | Kandle | 52/157 X |
| 3,952,523 | 4/1976 | Gale | 52/157 X |
| 4,492,493 | 1/1985 | Webb | 52/157 X |

FOREIGN PATENT DOCUMENTS

| | | | |
|---|---|---|---|
| 86774 | 7/1921 | Austria | 52/157 |
| 86/01849 | 3/1986 | World Int. Prop. O. | 52/165 |

*Primary Examiner*—J. Franklin Foss
*Attorney, Agent, or Firm*—Cort Flint

[57] ABSTRACT

A post anchor (A) is disclosed for anchoring a post (18) and the like in ground soil which comprises an elongated shank (10) having a boring end (14) and a bracket end (16). An auger (B) is carried at least near the boring end of the shank for boring a hole in the soil. A bracket (C) is carried near the bracket end of the shank for attaching the post to the shank. A compactor plate (D) is carried by the shank near the bracket end for compacting the soil between the compactor plate and the auger. A drive coupling (F) attaches to the bracket for connecting to a power drive for rotating the coupling and elongated shank. The drive coupling has a first position for connecting to the bracket for screwing the anchor into the ground and a second position for connecting it to the bracket for screwing the anchor out of the ground. A stabilizing cap (G) includes a footing plate (52) and a vertical stabilizing rim (56) which penetrates the soil to stabilize the anchor against lateral forces in 360 degrees of direction.

18 Claims, 3 Drawing Sheets

STABILIZED POST ANCHOR

BACKGROUND OF THE INVENTION

This is a continuation-in-part of Ser. No. 189,755, filed on May 2, 1988, entitled POST ANCHOR, now U.S. Pat. No. 4,863,137

The invention relates to an anchor for a post or tie down. In particular, the invention is constructed for anchoring a fence post or other structural member.

Anchor devices are known for anchoring posts and tie downs. Auger type devices are known in U.S. Pat. Nos. 4,593,872; 3,698,144; 997,710; and 513,115. Various brackets are proposed for mounting the posts to the anchor. One problem that arises in auger type devices is that the nature of the auger is that the soil is loosened as the auger bores into the soil. This tends to make the device less stationary in the soil. Wobbling or other movement of the anchor device could cause it to become loose to a point where it is no longer effective. U.S. Pat. No. 3,011,598 proposes a sleeve with vanes which may secure the upper part of the anchor in the soil.

It is also known to provide for a drive that will screw the auger type device into the ground easing and facilitating its use. For example, U.S. Pat. No. 3,830,315 discloses an auger type anchor which may be driven into the ground by a power drive. The drive mechanism is fairly complicated using worm and spur gears requiring a large driving force for actuation. U.S. Pat. No. 4,593,872 discloses a T-handle which can be used to screw the anchor into the ground. None of these devices are entirely satisfactory for use with a small power drive such as a drill or other rotary drive in a simple manner.

Accordingly, an object of the invention is to provide a post anchor which is stabilized in the ground for increased anchoring ability.

Another object of the invention is to provide a post anchor having a drive coupling so that the anchor may be driven in and out of the ground in a simple and efficient manner.

Another object of the invention is to provide a post anchor which may be set in the ground without the need of concrete or other setting material without undue labor, effort, and cost.

Another object of the invention is to provide a post anchor which may be driven in and out of the ground for repositioning and may be stabilized in an anchor position in the ground even with repeated setting of the anchor.

Still another object of the invention is to provide a stabilized post anchor which effectively resists forces encountered in the application of large and heavy posts.

SUMMARY OF THE INVENTION

The above objectives are accomplished according to the invention by providing an elongated shank having at least one auger type blade element near its free end. A post bracket is carried near the opposite end of the shank and includes two slidable L-shaped legs between which a post or other structural member may be attached. The upstanding legs may be engaged by a coupling drive plate having opposed slots formed in its ends which engage the legs of the bracket. A drive nut is secured on each side of the coupling plate for connection to a power drive. The coupling plate may be reversed on its sides to drive the auger in and out of the ground by simply reversing the plate. A compactor plate is carried near the bracket which compacts the soil loosened by the auger blade so that the anchor is tightly compacted and anchored in the ground between the compactor blade and the auger. A cap plate integral with the shank near the post bracket includes a footing plate and a vertical stabilizing rim which penetrates the soil and resists forces uniformly in 360 degrees of direction.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
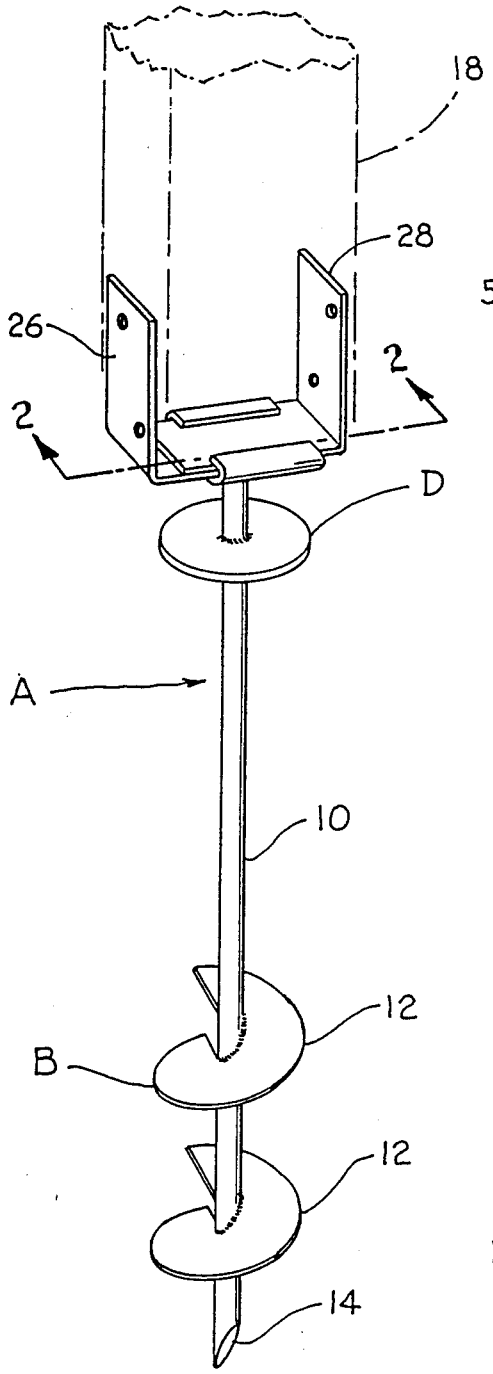
FIG. 1 is a perspective view of a post anchor constructed in accordance with the present invention.

Referring now in more detail to the drawings, a post anchor, designated generally as A, is disclosed which includes an elongated shank 10 and auger means in the form of at least two auger blades 12 carried near the boring end 14 of the anchor. Opposite boring end 14 of shank 10 is a bracket end 16. A bracket means C is carried by shank 10 near bracket end 16 for attaching a post 18 to the anchor.

Compactor means D is carried by shank 10 near bracket end 16 for compacting the soil 20 between compactor means D and auger means B. Compactor means D includes a horizontal annular disk plate 22 fixed by welding or other means to shank 10 in a range of about 2–3 inches from bracket end 16. As can best be seen in FIG. 2, soil is compacted with increasing density from auger blades 12 towards compactor disk plate 22. In this manner, the soil loosened by the turning in of auger blades 12 is at the same time pushed downward by compactor plate D where it is densified so that the soil is compacted for increased anchoring.

Bracket means E includes a first slide bracket 24 welded to bracket end 16 of shank 10, and second and third generally L-shaped brackets 26 and 28, respectively. Second bracket 26 includes a leg **26*a* which slides in bracket 24, as can best be seen in FIGS. 4 and 1. Bracket 28 includes a similar leg 28*a* which slides within a C-shaped channel 30 of first slide bracket 24. Second and third brackets slide towards and away from each other to adjust for attachment of post 18, as can best be seen in FIG. 2**.

Figure 3:
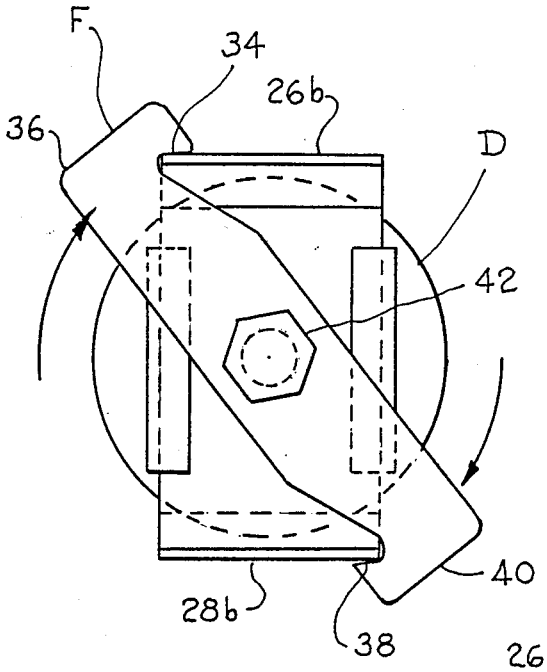
FIG. 3 is a top plan view illustrating a drive coupling for power driving the anchor in and out of the ground.
Figure 4:
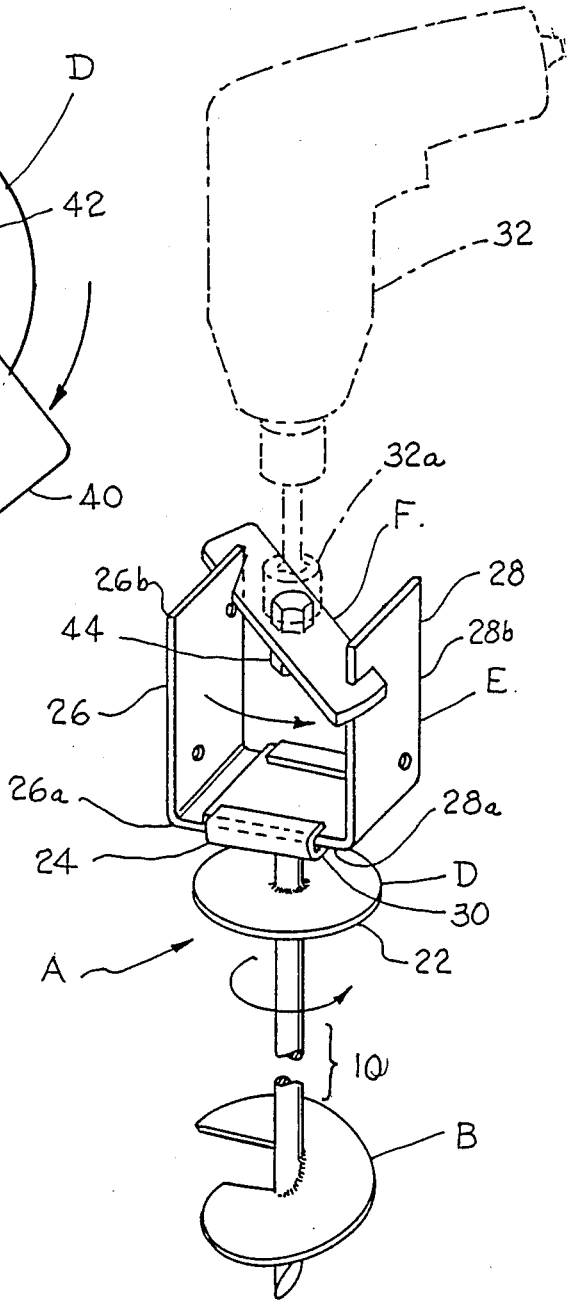
FIG. 4 is a perspective view of the anchor device and drive coupling being driven by a power tool.

Drive coupling means F for connecting anchor A to a power driven tool 32 can best be seen in FIG. 4. Coupling means F includes a first slot 34 formed in an end 36 and a second slot 38 formed in a second end 40. Slots 34 and 38 are constructed and arranged so that coupling means F which is in the form of a plate may be reversed on its sides to turn anchor A in opposing directions for screwing the anchor in and out of the soil. As can best be seen in FIG. 3, slots 34 and 38 are formed in such a manner that they lie approximately 180 degrees opposite each other. A drive nut 42 is carried on one side of coupling plate F and an identical drive nut 44 is carried on the opposing side of plate F. A corresponding socket 32*a* of power tool 32 connects to the drive nuts for screwing the anchor in and out of the ground. A first position of the coupling means in which anchor A screws into the ground is shown in FIG. 3. A second position of coupling means F is shown in FIG. 4 in which anchor A screws out of the ground. Slots 34 and 38 engage on opposite sides of vertical legs 26*b* and 28*b* of brackets 26 and 28, respectively, in the respective first and second positions.

Figure 2:
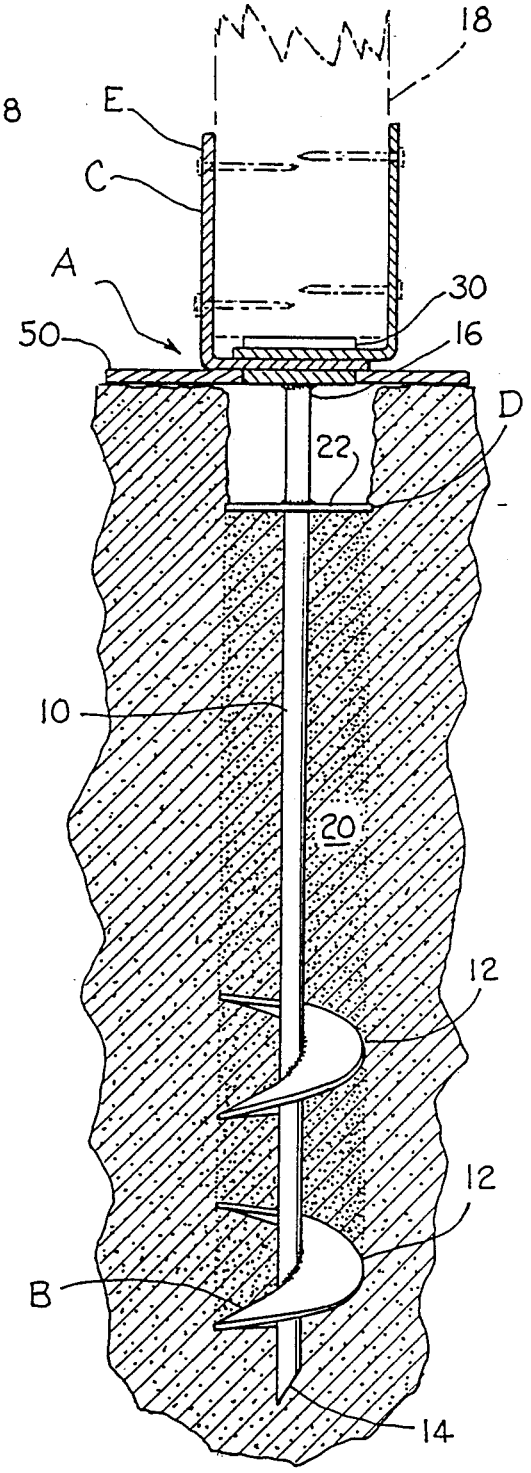
FIG. 2 is an elevation of a post anchor constructed in accordance with the present invention anchored in the ground.

As can best be seen in FIG. 2, a foot plate 50 may optionally be used for stabilizing anchor A. This is particularly useful when the anchor is being used as a footing to anchor a structural post for a wall or like structure. Plate 50 may be an annular or other shaped plate affixed to bracket end 16 in any suitable manner such as by welding.

Figure 5:
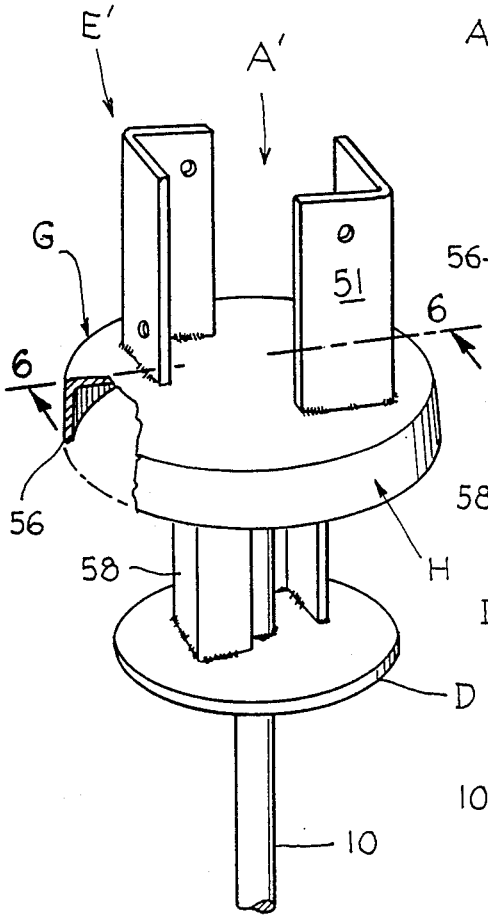
FIG. 5 is a perspective view of a stabilized heavy duty post anchor constructed in accordance with the invention.
Figure 6:
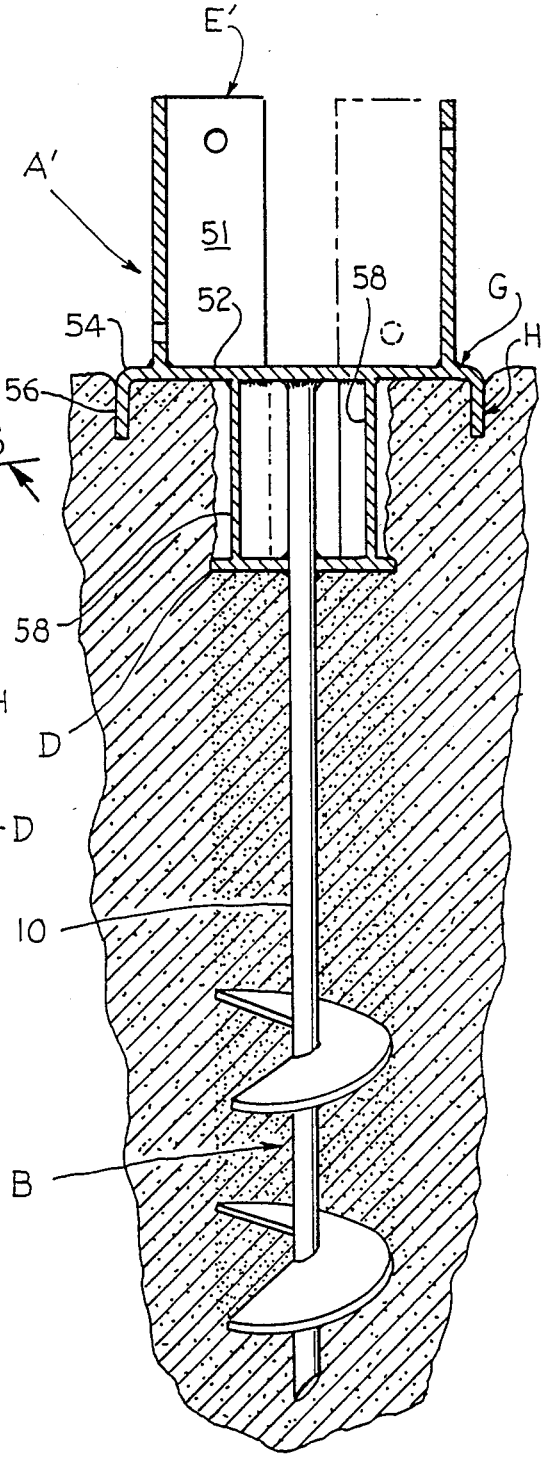
FIG. 6 is a sectional view taken along line 6—6 of FIG. 5.

As can best be seen in FIGS. 5 and 6, a stabilized embodiment of the invention is illustrated for application to large and heavy posts. An integral cap means G is carried about shank 10 near the bracket end between compactor plate D and bracket means E′ which includes vertically depending stabilizing means H for penetrating the soil and stabilizing the anchor in the soil. Bracket means E′ includes opposed upstanding "L" brackets 51 in which a 4×4 may fit. The power drive coupling of FIGS. 3 and 4 may be used with bracket means E′. Bracket means E may also be used with the stabilized embodiment in FIGS. 5 and 6. Cap means G includes a footing plate 52, which provides a footing for an anchored post, carried transverse to shank 10 having an outer periphery 54. Stabilizing means H includes a peripheral flange or rim 56 depending downwardly from the foot plate penetrating the soil and stabilizing the anchored post against lateral forces. Preferably, peripheral flange 56 includes a continuous circular flange carried concentrically about the shank to provide uniform stabilization against lateral forces in 360 degrees of direction. If footing plate 52 is spaced above compactor plate D sufficiently a reinforcing web 58 may be included between footing plate 52 and compactor plate D. This web strengthens the anchor so that when used with posts 5′ to 8′ sufficient structural integrity exists. The stabilized post anchor A′ is advantageous for posts 5′ to 8′ which are to be used free-standing. Stabilizing cap G and compacting plate D achieve effective anchoring of posts. Following penetration of the soil by the auger, compacting plate D follows to repack the soil, and then cap G caps and stabilizes the anchor in the soil.

While a preferred embodiment of the invention has been described using specific terms, such description is for illustrative purposes only, and it is to be understood that changes and variations may be made without departing from the spirit or scope of the following claims.

What is claimed is:

1. A post anchor for anchoring a post in ground soil comprising:

an elongated shank having a boring end and a bracket end;

auger means carried at least near the boring end of said shank for boring a hole in said soil;

bracket means carried near said bracket end of said shank for attaching said post to said shank; and a compactor plate carried by said shank near said bracket end for compacting said soil between said compactor plate and said auger means; and cap means integrally carried about said shank near said bracket end between said compactor plate and said bracket means which includes vertically depending stabilizing means for penetrating said soil and stabilizing said anchor in said soil.

2. The device of claim wherein said cap means includes a footing plate carried transverse to said shank having an outer periphery, and said stabilizing means includes a peripheral flange depending downwardly from said foot plate penetrating said soil so that said foot plate provides a footing for an anchored post and said peripheral flange stabilizes said anchored post against lateral forces.

3. The device of claim 2 wherein said peripheral flange includes a continuous circular flange carried concentrically about said shank to provide uniform stabilization against lateral forces in 360 degrees of direction.

4. The device of claim 2 including a vertical reinforcing web extending between said footing plate and said compacting means reinforcing said stabilization against lateral forces.

5. The device of claim 1 wherein said stabilizing means includes a continuous circular flange carried by said cap means concentrically about said shank penetrating said soil to provide uniform stabilization against lateral forces in 360 degrees of direction.

6. The device of claim 1, wherein said compactor plate is in a range of about 2 to 3 inches from said bracket means.

7. The device of claim 1, wherein said auger means includes at least a pair of auger-type blades having a helix, said blades constructed and arranged to bore and move soil upwards to compact said soil towards said compactor plate and stabilize said shank and anchor in said soil.

8. A post anchor for anchoring a post in ground soil comprising:

an elongated shank having a boring end and a bracket end;

auger means carried at least near said boring end of said shank for boring a hole in said soil;

bracket means carried near said bracket end of said shank for attaching said post to said shank;

a drive coupling means for attachment to said bracket means and for coupling to a power drive which for rotating said coupling means, said drive coupling means having a first position for connecting to said bracket means for screwing said shank into said ground and a second position for connecting to said bracket means for screwing said shank out of said ground; and cap means integrally carried about said shank near said bracket end which includes vertically depending stabilizing means for penetrating said soil and stabilizing said anchor in said soil.

9. The device of claim 8 wherein said cap means includes a footing plate carried transverse to said shank having an outer periphery, and said stabilizing means includes a peripheral flange depending downwardly from said foot plate penetrating said soil so that said foot plate provides a footing for an anchored post and said peripheral flange stabilizes said anchored post against lateral forces.

10. The device of claim 9 wherein said peripheral flange includes a continuous circular flange carried concentrically about said shank to provide uniform stabilization against lateral forces in 360 degrees of direction.

11. The device of claim 8 wherein said stabilizing means includes a continuous circular flange carried by said cap means concentrically about said shank to provide uniform stabilization against lateral forces in 360 degrees of direction.

12. The device of claim 7 wherein said stabilizing means includes a continuous circular flange carried by said cap means concentrically about said shank penetrating said soil to provide uniform stabilization against lateral forces in 360 degrees of direction.

13. The device of claim 8, wherein said bracket means includes a slide bracket means affixed to said bracket end of said shank, a first bracket means slidably carried by said slide bracket means having a first upstanding leg, a second bracket means slidably carried by said slide bracket means having a second upstanding leg, said first and second legs affixing said post to said shank.

14. The device of claim 13 including:

said drive coupling means having a first end and a second end, first angled slot formed in said first end for receiving said first upstanding leg and a second angled slot formed in said second end for receiving said second upstanding leg for screwing said shank into said soil, said first and second angled slots being constructed and arranged so that said coupling member may be reversed and said first slot receive said second leg with said second slot engaging said first leg for screwing said shank out of said soil.

15. A post anchor for anchoring a post in ground soil comprising:

an elongated shank having a boring end and a bracket end;

auger means carried at least near said boring end of said shank for boring a hole in said soil;

bracket means carried near said bracket end of said shank for attaching said post to said shank;

compactor means carried by said shank near said bracket end, said compactor means and auger means being constructed and arranged so that said soil is compacted between said compactor plate and said auger means;

a drive coupling means for attachment to said bracket means and for coupling to a power drive which for rotating said coupling means and elongated shank, said drive coupling means having a first position for connecting to said bracket means for screwing said shank into said ground and a second position for connecting to said bracket means for screwing said shank out of said ground;

cap means integrally carried about said shank near said bracket end between said compactor plate and said bracket means which includes vertically depending stabilizing means for penetrating said soil and stabilizing said anchor in said soil.

16. The device of claim 15 wherein said cap means includes a footing plate carried transverse to said shank having an outer periphery, and said stabilizing means includes a peripheral flange depending downwardly from said foot plate penetrating said soil so that said foot plate provides a footing for an anchored post and said peripheral flange stabilizes said anchored post against lateral forces.

17. The device of claim 16 wherein said peripheral flange includes a continuous circular flange carried concentrically about said shank to provide uniform stabilization against lateral forces in 360 degrees of direction.

18. The device of claim 15 stabilizing means includes a continuous circular flange carried by said cap means concentrically about said shank to provide uniform stabilization against lateral forces in 360 degrees of direction.

* * * * *

UNITED STATES PATENT AND TRADEMARK OFFICE

CERTIFICATE OF CORRECTION

PATENT NO. : 4,923,165
DATED : May 8, 1990
INVENTOR(S) : Boyce R. Cockman

It is certified that error appears in the above-identified patent and that said Letters Patent is hereby corrected as shown below:

Title page.
Item [54] Inventor, add -- Norman F. Cockman --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*